US005186404A

United States Patent [19]

Wark

[11] Patent Number: 5,186,404

[45] Date of Patent: * Feb. 16, 1993

[54] ADJUSTABLE FLOW RATE DEVICE FOR ROTATING VANE PULVERIZER

[75] Inventor: Rickey E. Wark, Pontiac, Mich.

[73] Assignee: Sure Alloy Steel Corporation, Warren, Mich.

[ * ] Notice: The portion of the term of this patent subsequent to Feb. 25, 2009 has been disclaimed.

[21] Appl. No.: 740,979

[22] Filed: Aug. 6, 1991

Related U.S. Application Data

[63] Continuation-in-part of Ser. No. 597,856, Oct. 15, 1990, Pat. No. 5,090,631.

[51] Int. Cl.[5] ..... B02C 15/00

[52] U.S. Cl. ..... 241/119; 241/55

[58] Field of Search ..... 241/117-121, 241/60, 61, 55, 57

[56] References Cited

U.S. PATENT DOCUMENTS 4,598,872 7/1986 Henne et al. ..... 241/19
4,907,751 3/1990 Wark et al. ..... 241/119
5,090,631 2/1992 Wark ..... 241/119

FOREIGN PATENT DOCUMENTS 264156 1/1989 German Democratic Rep. .

*Primary Examiner*—Douglas D. Watts
*Attorney, Agent, or Firm*—Krass & Young

[57] ABSTRACT

An air flow rate control device for a rotating or stationary vane throat in a bowl mill pulverizer. The air flow rate control device comprises an adjustable deflector mounted on the lower surfaces of the pitched vanes to provide varying air flow passage cross sections. In one embodiment the deflector comprises a flexible member whose shape can be varied using manual adjustment apparatus to alter the air flow passage cross-section.

30 Claims, 4 Drawing Sheets

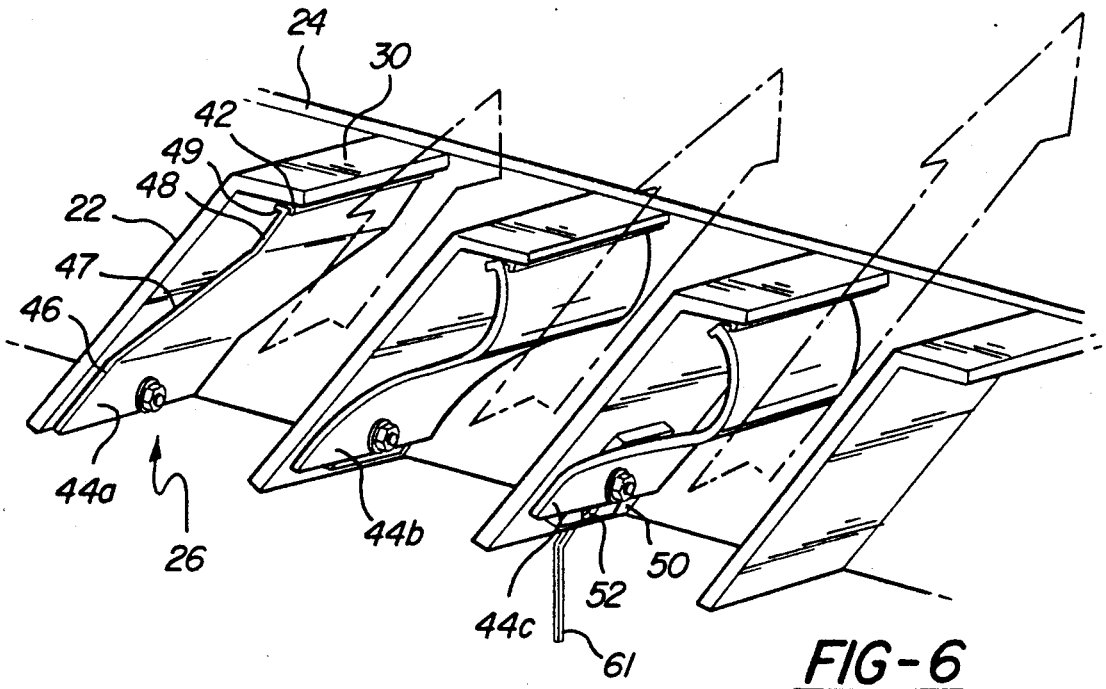
FIG-6
FIG-7
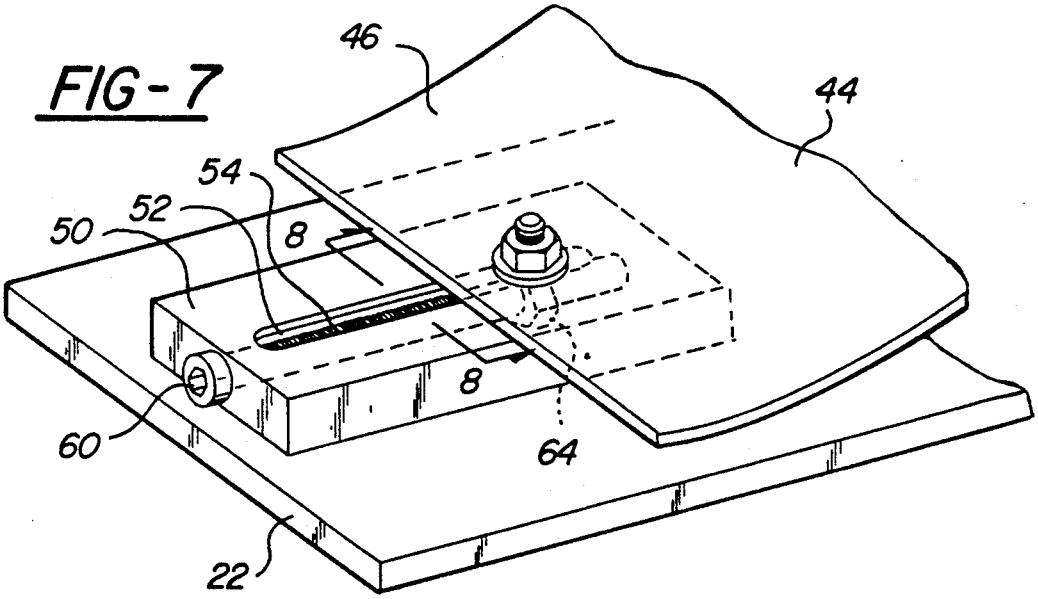
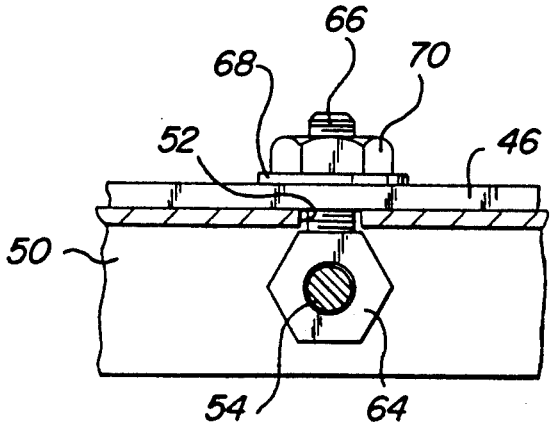
FIG-8

ADJUSTABLE FLOW RATE DEVICE FOR ROTATING VANE PULVERIZER

PRIOR APPLICATION

This application is a continuation-in-part of U.S. Ser. No. 07/597,856 filed Oct. 15, 1990 now U.S. Pat. No. 5,090,631 issued Feb. 25, 1992.

FIELD OF THE INVENTION

This invention relates to coal pulverizers and more particularly to an improved mechanism for controlling air flow rate through the air passages between pitched vanes in the pulverizer throat.

BACKGROUND OF THE INVENTION

Pulverizers such as bowl mills are commonly used to prepare coal for introduction into the combustion chambers of steam generators; representative pulverizers are currently offered for sale by Babcock and Wilcox, Foster-Wheeler and Combustion Engineering. Bowl mill pulverizers typically perform a classification function through the use of a vertical air flow through a "throat" which is made up of a circular arrangement of pitched vanes surrounding the outer periphery of the pulverizing surface and forming air flow passages between a wind box and the classification area. The vanes are made up of metal plates usually welded to and between inner and outer rings. The vane assembly or "throat" may be stationary or it may be mounted for rotation about a vertical axis.

Air flow rate through the passages formed by the pitched vanes is a function of the effective cross-sectional area of the passages and the pressure head produced by the fans, turbines or other air drive mechanisms. It is desirable to control air flow rate through cross-sectional area adjustment to optimize pulverizer performance.

One prior art mechanism for controlling cross-sectional area and flow rate comprises spacer blocks which are bolted to the inside ring of the vane assembly. The blocks can come in various sizes or may be bolted on top of one another to reduce the size of the air flow passage and the air flow velocity. In this approach the spacer blocks are in the path of particulate matter flow and, therefore, are subject to abrasion and wear. As a consequence, the spacer blocks must be made of a more expensive wear resistant material. Moreover, it is a time consuming and cumbersome job to install and remove the spacer blocks.

An alternative approach to air flow control is disclosed in my U.S. Pat. No. 4,907,751, "Rotating Throat for Coal Pulverizer", issued Mar. 13, 1990. In that patent I disclose the use of slide-on, wear resistant vane liners in the form of metal plates which overlie the upper principal surface of the pitched vanes. Each liner plate has an integral angled portion which rests on the top edge of the vane and partially closes the air flow opening. The vane liners are held in place by means of arcuate overplates or caps which are bolted to the top surface of the inner portion of the vane/throat assembly. The degree to which the arcuate plates extend over the openings also affects the area of the air flow passage and the air flow rate. Like the spacer blocks, adjustment or change in air passage size can be achieved only by interchanging one set of liners or caps for others of a different size.

SUMMARY OF THE INVENTION

According to the present invention an apparatus is provided modifying the size of the air flow openings between the pitched vanes of a pulverizer throat, which mechanism is out of the main stream of particulate flow and may be made of inexpensive materials.

In general, this is achieved by attaching a deflector device, such as a steel shape, to the undersides of the pitched vanes to reduce at least a portion of the cross-sectional area of each flow passage to a desired degree.

According to a second aspect of the invention, the deflector devices are readily adjustable to the desired degree; moreover adjustment requires neither removal nor interchange of parts.

In a first embodiment of the invention this is achieved through the disposition of hinged deflectors with adjustment mechanisms on the under surfaces of the pitched vanes. In the preferred form the deflectors are simple relatively light-gage steel shapes, the lower edges of which are hinged to the surfaces of the pitched vanes and the upper portions of which are connected to the vane undersurfaces by means of a threaded fastener which permits infinite adjustment in the spacing between the deflector and the undersurface of the associated pitched vane. The passage between vanes may therefore be infinitely adjusted and caused to assume an essentially venturi shape wherein the cross-sectional area is gradually reduced toward the upper portion of the passage such that air flow rate gradually increases from a minimum at the entrance of the passage to a maximum at the exit of the passage.

In a second, ,embodiment of the invention this is achieved with flexible deflectors whose shape can be adjusted from an essentially flat configuration out of the associated air flow passage to a curved configuration extending into the associated air flow passage. The deflectors in a preferred form are formed of an at least partially flexible sheet of material, for example light gauge spring steel, the upper edges of which are essentially fixed to the surfaces of the pitched vanes and the lower edges of which are adjustable with respect to the vane undersurfaces. By adjusting the position of the lower edge of the deflector, the spacing of the flexible portion of the deflector from the vane can be varied so as to alter the cross-sectional area of the air flow passages between vanes.

A manual adjustment mechanism is mounted on the vane undersurface and the lower edge of the flexible deflector is fastened thereto. In one preferred embodiment the manual adjustment mechanism comprises an axial guide and traveler to which the lower edge of the deflector can be connected. The manual adjustment is operable to increase or decrease the distance between the ends of the deflector. In a particular embodiment, the axial guide comprises a threaded bolt rotatably mounted in a mounting block. A traveler nut on the threaded bolt travels axially therealong as the bolt is rotated. The lower edge of the flexible deflector is fastened to the traveler nut such that rotation of the threaded bolt results in the increase or decrease of the distance between the ends of the deflector.

The force exerted on the flexible portion of the deflector as its ends are brought together or pulled apart alters the shape of the deflector and of the associated air flow passage. The air flow passages between vanes may therefore be infinitely adjusted between low and high velocity venturi configurations wherein the cross-sectional area is gradually reduced toward the upper portion of the passage such that air flow rate gradually increases from a minimum at the entrance of the passage to a maximum at the exit of the passage.

These and other advantages will be more readily apparent from a reading of the following specification which describes one or more illustrative embodiments of the invention in detail.

IN THE DRAWINGS

FIG. 6 is a perspective view of a portion of the rotating vane assembly of FIG. 1 utilizing an alternate embodiment of the air flow rate control device of the present invention;

FIG. 7 is a perspective view of the manual adjustment mechanism of the alternate embodiment of the invention as shown in FIG. 6; and FIG. 8 is an end view of the manual adjustment mechanism of FIG. 7.

DETAILED DESCRIPTION OF AN ILLUSTRATIVE EMBODIMENT

Figure 1:
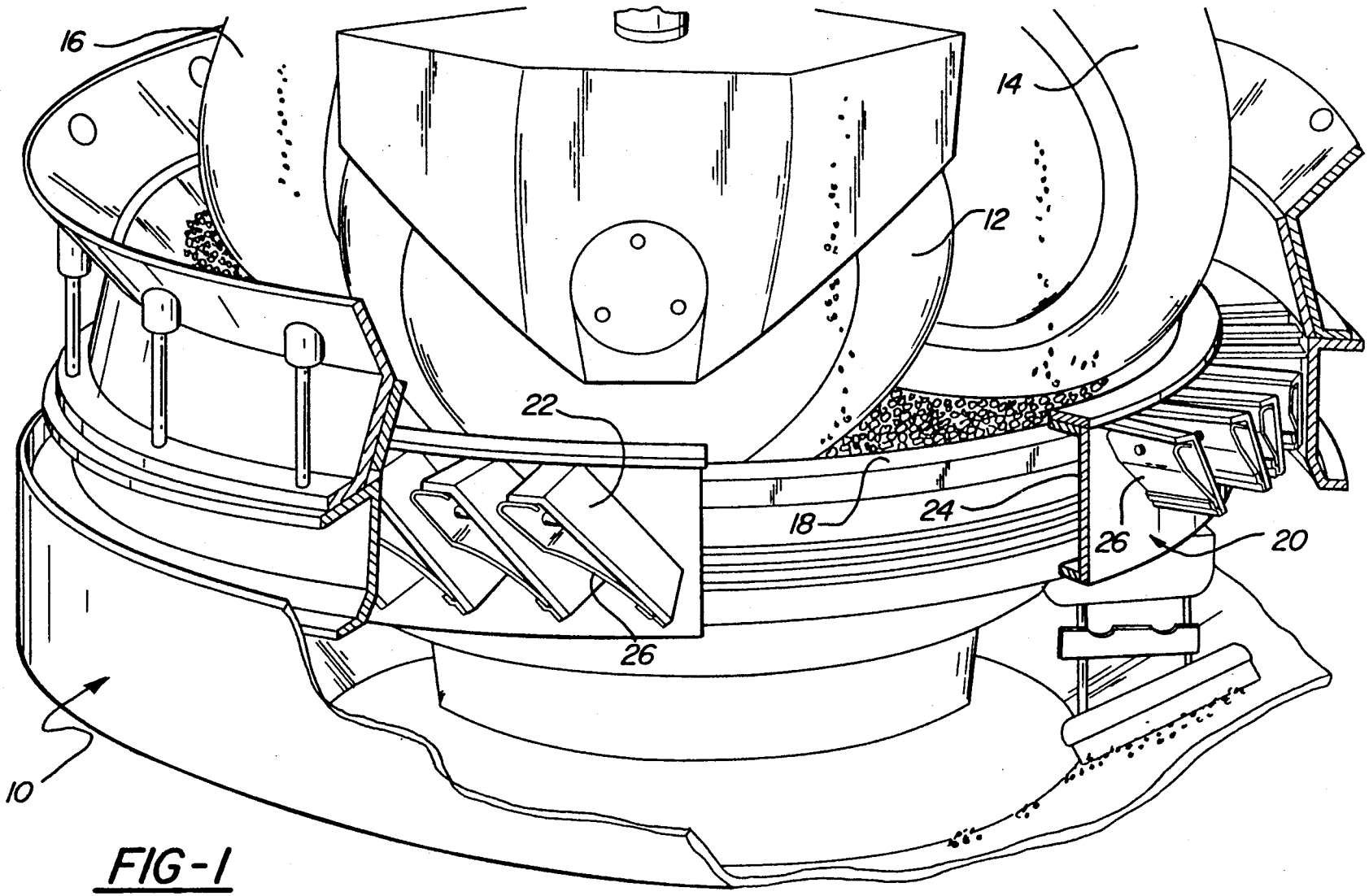
FIG. 1 is a perspective view partly in section of a bowl mill pulverizer utilizing a rotating vane arrangement employing an embodiment of the present invention.
Figure 4:
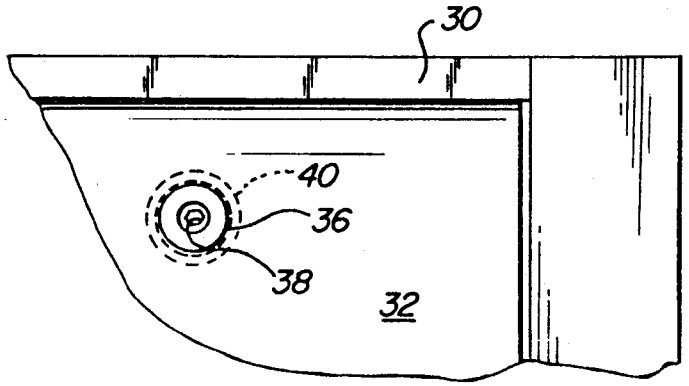
FIG. 4 is a front view of the device of FIG. 3.

Referring first to FIG. 1, a bowl mill type pulverizer 10 comprises grinding wheels 12, 14 and 16 operating to pulverize coal in a bowl 18. Surrounding the bowl 18 and rotatable therewith is a rotating vane assembly 20 which includes an essentially circular arrangement of uniformly spaced pitched steel vanes 22 through which air is caused to flow upwardly around the periphery of the grinding bowl 18 for the purpose of carrying fines upwardly to a classification area. Vanes 22 are welded to a steel inner ring 24 which is mounted for rotation around bowl 18. Larger particles of ground coal pass downwardly through the vanes 22 into the lower section of the bowl mill 10. The overall construction and operation of a bowl mill type pulverizer is well-known and will be apparent to those skilled in the art.

Figure 3:
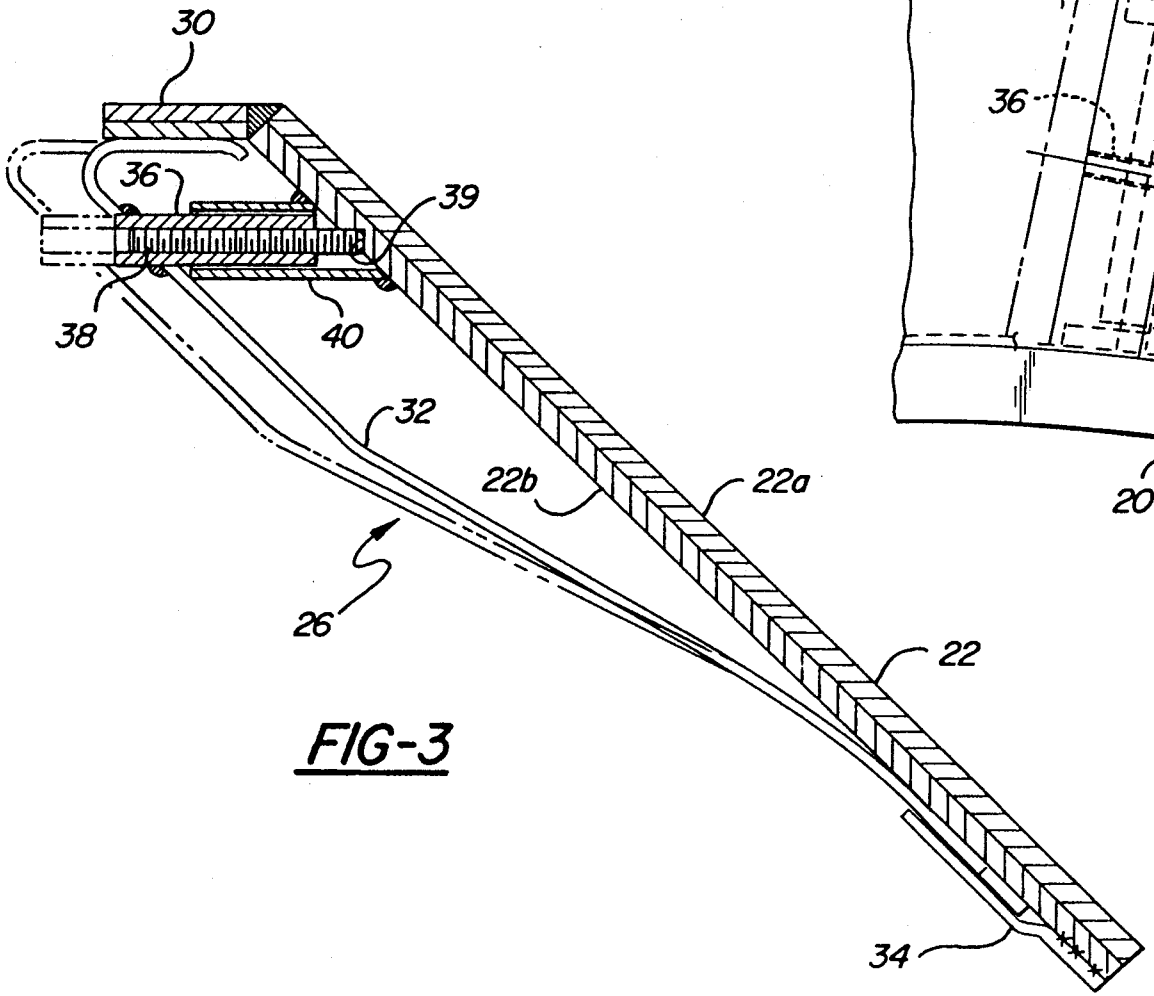
FIG. 3 is a side view of the assembled air flow rate control device.

In the embodiment of FIGS. 3, the pitched vanes 22 have major upper and lower plane surfaces **22*a* and 22*b*. Surface 22*a*, if unprotected, is subject to rapid wear due to the abrasive action of coal particles falling downwardly through the vane arrangement 20 as aforesaid. The lower plane surfaces 22*b*, although exposed to upwardly traveling fines, do not experience significant abrasion and, therefore, need not be protected. To protect the upper surfaces 22*a***, various devices may be used; for example, a layer of high hardness, wear resistant material may be welded to a soft steel plate to form a composite. The liner arrangement disclosed in my prior U.S. Pat. No. 4,907,751, the specification and disclosure of which is incorporated herein by reference, may also be employed. Alternatively, the vane plates may be hardened by heat treating or constructed entirely of high-hardness material.

In accordance with the present invention, air flow control devices 26 are adjustably mounted on the lower surfaces **22*b* of the vanes 22 for the purpose of controlling air flow velocity through the air passages defined by the vanes 22** as hereinafter described.

Referring now to FIGS. 2 through 5, the vanes 22 are shown to comprise rectangular composite steel plates which are welded between inner and outer rings 20 and 28. As represented by the structure of FIG. 1, outer ring 28 is not essential, but is the preferred construction. Smaller top plates 30 are welded to the vanes 22 at an angle to lie in a horizontal plane in the embodiment of FIG. 1. Each of the air flow control devices 26 comprises a deflector in the form of a (relatively light gage) spring steel shape 32 having a lower portion **32*a*, an intermediate planar portion 32*b* and a reversely bent top portion 32*c* which, when the shape 32 is properly installed on the lower surface of the vane 22 as hereinafter described, underlies the small top plate 30 of the vane 22**.

Figure 2:
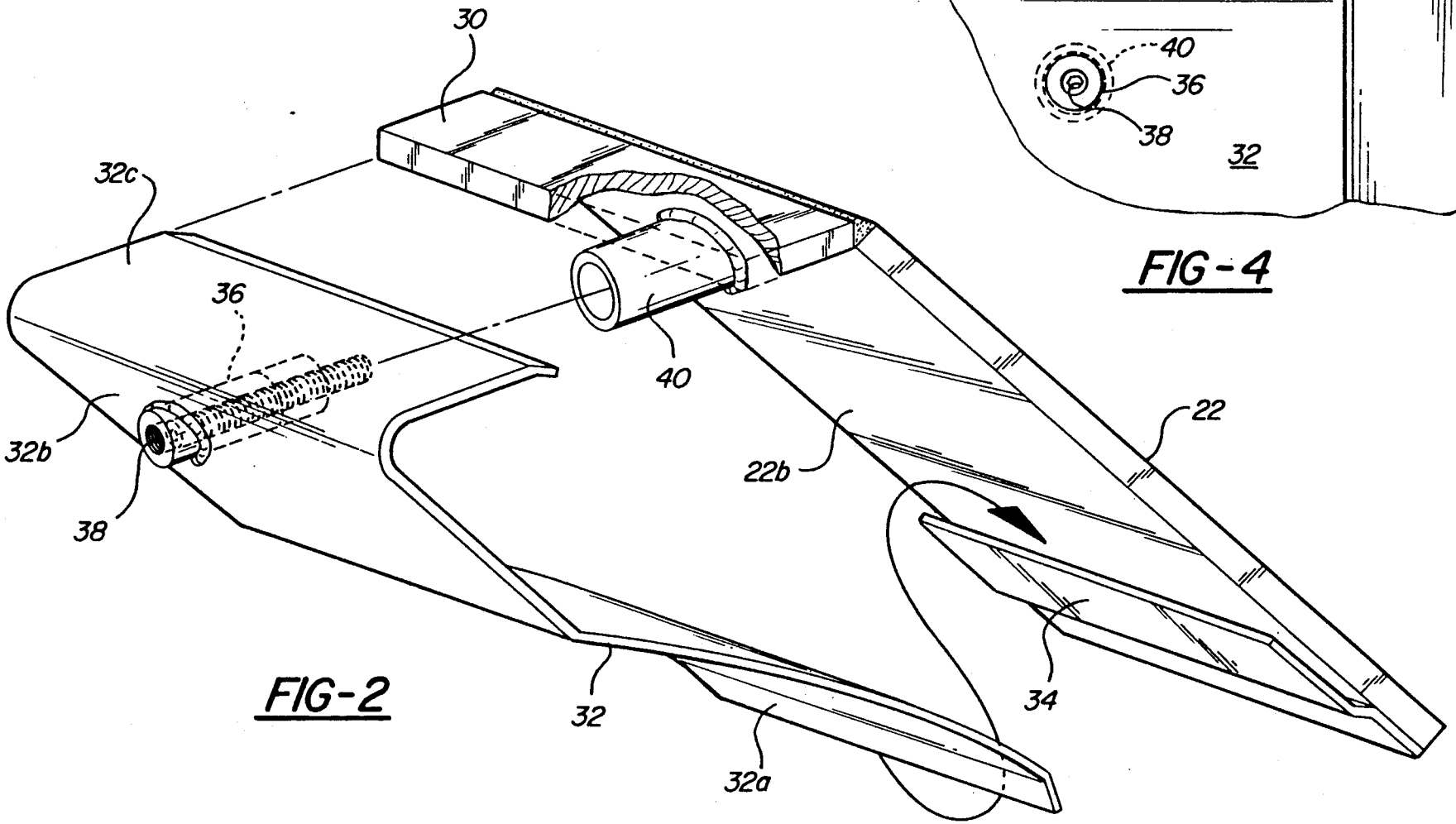
FIG. 2 is an exploded perspective view of components of the air flow rate control device in the pulverizer of FIG. 1.
Figure 5:
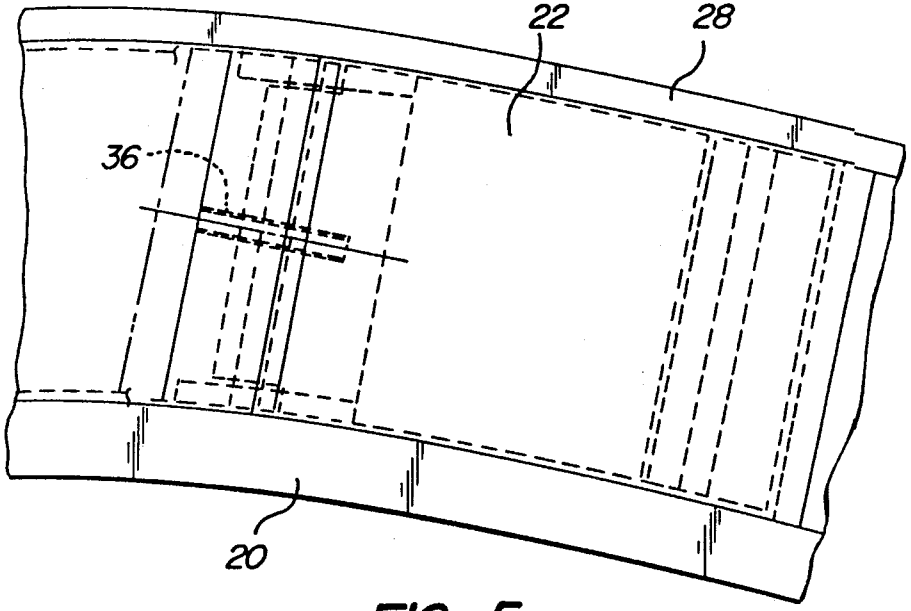
FIG. 5 is a plan view of a portion of the rotating vane assembly of FIG. 1.

As shown in FIGS. 2 and 3 a hinge plate or cup 34 is welded to the lower face of the vane 22 near the bottom to receive and hold the lowermost extremity **32*a* of the shape 32**, the degree of overlap being on the order of one-to-two inches to permit a hinge action and a sliding relative motion for purposes hereinafter explained.

A tubular nut 36 having a threaded inner bore is welded to the shape 32 in the intermediate planar portion **32*b* so as to protrude through the shape 32 and lie with its longitudinal axis extending essentially horizontally in the installed condition. An Allen-head bolt 38 is threaded into the tubular nut 36** for purposes hereinafter described.

An unthreaded tube 40 having an internal diameter which is slightly larger than the outside diameter of the tube 36 is bevel cut and welded to the lower surface of the vane 22 adjacent the top thereby to receive in relative sliding engagement the tube nut 36 carrying the Allen-head bolt 38. A pocket 39 is cut into the lower face **22*b* of the vane 22 to receive and provide a stop for the base of the nut 38**.

In the assembled condition shown in FIG. 3, the bottom extremity **32*a* of the shape 32 fits into the hinge plate 34, the bolt 38 is threaded into the nut 36 and the nut 36 is disposed into the tube 40 such that the top portion 32*c* of the shape 32 immediately underlies and bears lightly against the lower surface of the minor vane plate 30. The spring action of the steel shape 32 while engaged within the hinge plate 34 serves as a bias to urge the shape 32 toward the lower face of the vane 22 and adjustment of the relative spacing between the shape 32 and the lower surfaces of vane 22 is determined by rotating the threaded bolt 38 in the nut 36. As will be apparent from an examination of the assembly of FIG. 3 urging the bolt 38 farther into the trapped tubular nut 36 displaces the shape 32 away from the lower surface of the vane 22. In the assembled environment of FIG. 1, displacing the shape 32 away from the lower surface of the vane 22 reduces the area in the cross section between vanes 22 and causes a corresponding increase in air flow velocity, assuming a constant air flow pressure head. Moreover, the shape 32 slides slightly upwardly in the hinge plate 34 to accommodate the essentially rectilinear motion which is produced by the particular orientation of the adjustor mechanism including tubes 36 and 40 and nut 38**.

It will also be seen in FIG. 3 that the shape of the air flow passage between vanes is essentially that of a venturi; i.e., it is only marginally reduced near the entry of the passage but then becomes gradually smaller as a result of the location of the shape 32 in the passage and the greater degree of spacing between the shape and the vane 22 which occurs toward the top of the passage. Accordingly, air is permitted to accelerate gradually and relatively uniformly toward the top of the air flow passage. As will be apparent to those skilled in the mechanical fabrication arts, the hinge 34 may be constructed in a variety of alternative ways and the adjustment mechanism provided in this case by the tubes 36 and 40 and the Allen-head bolt 38 may also be constructed and implemented in a variety of ways. For example, rotary hinges may be employed where the adjustment mechanism is mounted essentially orthogonally to the vane, this arrangement calling for a variation in the shape of the top of the shape 32 and a filler device beneath the plate 30 at the top of the vane. The shapes 26 may be made from a variety of materials from relatively light gage spring steel to harder, thicker steels and may also be plated, coated or heat treated for increased durability as desired. Many such alternatives, as well as accommodations to differing vane and vane wheel designs, will occur to those skilled in the mechanical arts.

Referring now to FIGS. 6–8, an alternate embodiment is shown in which air flow control devices 26 comprise flexible deflectors 44 adjustably mounted on the lower surfaces of the vanes 22 for the purpose of controlling air flow velocity through the air passages defined between the vanes. Deflectors 44 in the illustrated embodiment comprise rectangular sheets of flexible, light-gauge spring steel, although other materials having suitable durability and flexibility may be used. Each of the deflectors 44 has a lower end 46 essentially coplanar with surface 22*b*, an intermediate portion 47 angled outwardly from the plane of lower end 46, and an upper end 48 essentially parallel to but spaced from lower end 46. Upper end 48 exhibits a folded portion 49 turned at approximately right angles to the planar surface of end 48. Top plate 30 of the vane 22 in the embodiment shown in FIG. 6 includes a complementary flange 42 having an L-shaped cross-section to matingly receive the folded portion 49.

Referring still to FIGS. 6 to 8, a manual adjustment mechanism for the lower end 46 of the deflectors comprises a mounting block 50 fixed such as by welding to the lower surface of vane 22. Mounting block 50 has a longitudinal guide slot 52 formed in the upper surface thereof to receive a short threaded shaft 66 welded to and projecting outwardly from the face of a nut 64 mounted on a threaded stud bolt 54 trapped at both ends 56,58 in rotatable fashion within the box 52. Lower end 58 of stud 54 projects beyond the interior of the mounting block 50 and has formed thereon an Allen-head 60 which accepts an Allen wrench 61 in a known manner to effect rotation of the stud.

The nut 64 threaded on stud 54 is held against rotation by the dimensions of the slot 52. Accordingly, nut 64 is caused to travel axially therealong in response to rotation of the stud. Traveler nut 64 is shown in the illustrated embodiment as a standard hexagonal nut with a threaded bore, but may take other forms. For example, the nut may be elongated, or have a cross-section other than hexagonal.

Lower end 46 of deflector 44 has formed therein a hole (not shown) aligned with and of a suitable size to admit stud 66. The lower end 46 of deflector 44 is fastened to stud 66 and mounting block 40 by way of a washer 68 and lock nut 70 as best shown in FIG. 8. Tightening lock nut 70 sandwiches lower end 46 between washer 68 and the surface of mounting block 50 in a tight friction-fit.

In FIG. 6, three deflectors 44*a*, 44*b*, and 44*c* mounted on respective vanes 22 are shown adjusted to different positions corresponding to low, intermediate and high air flow velocity between the vanes as indicated by the arrows. Altering the shape of the deflector 44 from the relaxed or unadjusted position indicated at 44*a*, in which the deflector is essentially flat, to the flexed or curved configurations shown at 44*b* and 44*c* is accomplished by forcing the lower end 46 toward the upper end 48 held in place by L-shaped flange 42. The resulting forces exerted on deflector 44 serve to flex the intermediate portion 47 outwardly into the air flow passage defined between the deflector and the top surface 22*a* of an adjacent vane 22. It can be seen that this results in the shaping of the air flow passage into a progressively more well-defined venturi. As is well-known, the velocity of fluid flow exiting the narrow throat of the venturi increases in an inversely proportional manner to its cross-sectional area. The closer the ends of deflector 44 are brought together, the smaller the cross-sectional area of the air flow passage, resulting in increasing air flow velocity through the passage as the deflector progresses from the relaxed, low-velocity venturi configuration shown at 44*a* to the high-velocity venturi configuration shown in 44*c*.

To increase or decrease the distance between ends 46 and 48 of deflector 44 between the positions shown in 44*a*, 44*b* and 44*c*, lock nut 70 is first loosened enough to permit the lower end 46 of the deflector to slide with stud 66 along the surface of mounting block 50. Allen wrench 61 is then inserted in Allen-head socket 60 of the threaded guide bolt 54 to rotate the bolt, causing traveler nut member 64 and stud 66 to be axially translated therealong within the guide slot 52. Lower end 46 of deflector 44 fastened to stud 66 is thereby moved up or down in relation to the top plate 30 of vane 22 in order to increase or decrease the distance between ends 46 and 48. When the desired configuration of deflector 44 has been reached, lock nut 70 is tightened down to lock lower end 46 in place on mounting block 50 to prevent inadvertent movement during the operation of the vane assembly.

It can be seen in FIG. 6 that as the lower end 46 of deflector 44 is translated toward upper end 48, causing the intermediate portion 47 of the deflector to flex outwardly into the air flow passage, folded portion 49 on upper end 48 is moved slightly out of engagement with L-shaped flange 42 on the undersurface of top plate 30 toward the lower surface 22*b* of vane 22. Friction and the compressive force on deflector 44 serve to hold upper end 48 in place as shown at 44*b* and 44*c*; L-shaped flange 42 engages folded portion 49 when the deflector is relaxed as shown at 44*a* to prevent its dislocation from the undersurface of top plate 30. It will of course be understood by those skilled in the art that various methods of fastening upper end 48 of deflector 44 to vane 22 are possible.

It will also be understood by those skilled in the art that the manual adjustment mechanism shown in FIGS. 6–8 comprising mounting block 50, threaded guide bolt 54, traveler nut 64 and stud 66 is an illustrative embodiment only, and that other embodiments which will be apparent to those skilled in the art may lie within the scope of the claimed invention. Additionally, the shape of deflectors 44 is not limited to that shown in the illustrated embodiment, but may vary with the shape of the vanes 22 or the preferences of the manufacturer or operator, so long as they function essentially as described above.

I claim:

1. In a pulverizer of the type which includes an essentially circular arrangement of pitched vanes forming air flow passages therebetween and having upper and lower plane surfaces;

air flow velocity control means comprising deflector means for deflecting air in said air flow passages, the deflector means mounted on the lower plane surfaces of at least some of said vanes; and, means for varying the spacing of a flexible portion of the deflector means from the lower surface of the vane by flexing it outwardly into said air flow passage.

2. For use with a pulverizer of the type which includes a circular arrangement of pitched vanes forming air passages and having upper and lower exposed surfaces, apparatus for adjusting the air flow rate through said passages comprising:

deflector means mounted on the lower surfaces of respective vanes; and adjustment means associated with each of said deflector means for selectively varying the spacing of a portion thereof from the lower surface of the vane to adjust the cross-sectional area of the associated passage.

3. Apparatus as defined in claim 2, wherein first and second ends of the deflector means are connected to said lower surface, said adjustment means being selectively operable to vary the spacing between said first and second ends of the deflector means.

4. Apparatus as defined in claim 3, wherein said first end of the deflector means is essentially fixed with respect to the vane, and said second end is connected to the vane by the adjustment means to be movable toward and away from said first end.

5. Apparatus as defined in claim 3, wherein the deflector means is an at least partially flexible sheet approximately the width and height of the associated vane.

6. Apparatus as defined in claim 4, wherein the deflector means has an intermediate flexible portion between said first and second ends.

7. Apparatus as defined in claim 6, wherein said adjustment means is manually operable to extend said intermediate flexible portion into the air flow passage to define a venturi therebetween.

8. Apparatus as defined in claim 7, wherein said deflector means in a first unadjusted position is essentially flat and in a second adjusted position the intermediate flexible portion curvingly extends into said air flow passage.

9. In combination: a pulverizer vane assembly including a rigid inner support ring and a plurality of pitched rigid vanes secured to and extending radially from said ring at circumferentially uniformly spaced intervals, each of said pitched vanes having parallel planar upper and lower surfaces and forming air passages therebetween; and position-adjustable means disposed on and adjustable relative to the lower surfaces of the pitched vanes for selectively varying the effective area of said air passages;

wherein said position-adjustable means comprise a plurality of deflector means and means for adjustable mounting individual deflector means on respective lower vane surfaces, said adjustment means being operable to vary the shape of the deflector means.

10. In a rotating vane assembly for a pulverizer, the vane assembly comprising a circular arrangement of pitched vanes fixed to the vane assembly to define air passages therebetween, the vanes having upper and lower surfaces, apparatus for adjusting the air flow rate through said passages comprising:

deflector means mounted on the lower surfaces of at least some of said vanes;

adjustment means associated with each of said deflector means for selectively varying the shape of a flexible portion of said deflector means to adjust the cross-sectional area of at least a portion of the associated passage.

11. Apparatus as defined in claim 10, wherein the deflector means in a first, unadjusted position define the associated passage as a low velocity venturi and in a second, adjusted position define the associated passage as a higher velocity venturi.

12. Apparatus as defined in claim 11, wherein the deflector means comprises a sheet of at least partially flexible material of approximately the dimensions of the lower surface of the vane, the deflector essentially flat in said first unadjusted position, the flexible portion of the deflector bowed outwardly into said air flow passage in said second position.

13. Apparatus as defined in claim 12, wherein said deflector means comprise a sheet of spring steel.

14. Apparatus as defined in claim 13, wherein said adjustment means is mounted on said lower surface of the vane.

15. Apparatus as defined in claim 14, wherein one end of said deflector means is essentially fixed to said lower surface, and an opposite end of said deflector means is connected to said adjustment means so as to be movable by said adjustment means toward and away from said fixed end.

16. In a vane assembly for a pulverizer, the vane assembly comprising a circular arrangement of pitched vanes fixed to the vane assembly to define air passages therebetween, the vanes having upper and lower surfaces, apparatus for adjusting the air flow rate through said passages comprising:

at least partially flexible deflector means mounted on the lower surfaces of respective vanes;

adjustment means associated with each of said deflector means on said vanes for selectively adjusting the shape of said deflector means between a first essentially flat configuration and a second curved configuration.

17. Apparatus as defined in claim 16, wherein the deflector means in said curved configuration extends into and reduces the cross-sectional area of the associated air passage to increase air flow velocity.

18. In a vane assembly for a pulverizer, the vane assembly comprising a circular arrangement of pitched vanes fixed to the vane assembly to define air flow passages therebetween, the vanes having upper and lower surfaces, apparatus for adjusting the air flow rate through said air passages comprising:

deflector means mounted on the lower surfaces of at least some of the vanes, said deflector means comprising at least partially flexible sheets having a height and width approximating that of the lower surface of said vanes, said deflector means connected at a first end to an upper end of the lower surface of said vanes, a second end of the deflector means connected by adjustment means to a lower end of said lower surface of the vane;

said adjustment means manually operable to move said second end of said deflector means toward and away from said first end to flex an intermediate portion of said deflector means between a first, essentially flat configuration corresponding to a maximum distance between said ends of the deflector means, and a second curved configuration corresponding to a lesser distance between said ends, so as to extend the flexible portion of the deflector means into the air passage associated therewith to decrease the cross-sectional area along a portion thereof in the manner of a venturi.

19. Apparatus as defined in claim 18, wherein said adjustment means comprise guide means mounted on the lower surface of the vane, traveler means on said guide means for axial travel therealong, and connector means for connecting said traveler means to said deflector means.

20. Apparatus as defined in claim 18, wherein said deflector means in said first, essentially flat configuration define said air passage as a lower velocity venturi, and in said second curved configuration define said air passage as a higher velocity venturi.

21. In a pulverizer of the type which includes an essentially circular arrangement of pitched vanes forming air flow passages therebetween and having upper and lower plane surfaces:

air flow rate control means comprising deflector means mounted on the lower plane surfaces of at least some of said vanes, said deflector means comprising upper and lower planar end portions connected to the lower plane surfaces of the vanes, said planar end portions connected by a flexible intermediate portion;

adjustment means on said lower plane surface of each vane, connected to said lower planar end portion of the deflector means to selectively move said lower planar end portion toward and away from said upper planar end portion;

said intermediate portion of the deflector means having an essentially planar configuration in a first, unadjusted position corresponding to a maximum distance between said upper and lower planar ends, and a curved configuration extending into the associated air flow passage in a second, adjusted position corresponding to a lesser distance between said upper and lower planar ends.

22. Apparatus as defined in claim 9 wherein the deflector means comprise a sheet of material having first and second ends connected to the lower vane surface and a deformable intermediate portion.

23. Apparatus as defined in claim 22 wherein the adjustment means is operable to vary the shape of the deflector between a first essentially flat configuration and a second curved configuration in which the intermediate portion of the deflector is bowed outwardly into the associated air passage.

24. Apparatus as defined in claim 23 wherein the adjustment means is operable to adjust the spacing between the first and second ends of the deflector, the first essentially flat configuration of the deflector corresponding to the maximum distance between the first and second ends, and the second curved configuration corresponding to a lesser distance between the first and second ends.

25. Apparatus as defined in claim 24 wherein the adjustment means comprise guide means mounted on said lower surface, traveler means for axial travel along said guide means, and connector means for connecting one end of the deflector means to said traveler means.

26. Apparatus as defined in claim 25, wherein the guide means comprise a threaded member manually rotatable to cause said travel means to travel axially therealong.

27. Apparatus as defined in claim 19 wherein the adjustment means further include lock means to lock the deflector means relative to the vane.

28. Apparatus as defined in claim 27 wherein the guide means include a mounting block rotatably supporting an axial threaded member aligned with a longitudinal axis of the deflector.

29. Apparatus as defined in claim 28 wherein the traveler means include a nut member mounted on the axial threaded member.

30. Apparatus as defined in claim 27 wherein the lock means frictionally sandwiches the end of the deflector to the guide means.

* * * * *